US005696740A

United States Patent [19]

Inabinet

[11] Patent Number: 5,696,740

[45] Date of Patent: Dec. 9, 1997

[54] TIMEPIECE FOR CONVERTING BETWEEN MILITARY AND CIVILIAN TIME

[76] Inventor: Lawrence E. Inabinet, 1-B Greenwood Park, Marion, S.C. 29571

[21] Appl. No.: 662,864

[22] Filed: Jun. 12, 1996

[51] Int. Cl.[6] ..... G04B 19/04; G04B 19/06

[52] U.S. Cl. ..... 368/80; 368/228; 368/238

[58] Field of Search ..... 368/76, 80, 82, 368/223, 228, 238

[56] References Cited

U.S. PATENT DOCUMENTS

| | | | |
|---|---|---|---|
| 290,116 | 12/1883 | Russell . | |
| 304,281 | 8/1884 | Russell . | |
| 393,000 | 11/1888 | Ethridge . | |
| 400,734 | 4/1889 | Bickford . | |
| 1,389,666 | 9/1921 | Jarred . | |
| 1,453,086 | 4/1923 | Varaud . | |
| 1,665,073 | 4/1928 | Schwanke . | |
| 3,184,912 | 5/1965 | Freeburg et al. | 368/238 |
| 3,540,209 | 11/1970 | Zatsky et al. . | |
| 4,223,402 | 9/1980 | Slemmons | 368/238 |
| 4,364,672 | 12/1982 | Shibuya et al. . | |
| 5,008,870 | 4/1991 | Vessa . | |
| 5,280,461 | 1/1994 | Belik . | |

FOREIGN PATENT DOCUMENTS

| | | |
|---|---|---|
| 642387 | 10/1927 | France . |
| 39365 | 10/1928 | Germany . |
| JA2-112790 | 4/1990 | Japan . |
| 363695 | 11/1922 | United Kingdom . |
| G 24 51 057 | 4/1975 | United Kingdom . |

*Primary Examiner*—Vit W. Miska
*Attorney, Agent, or Firm*—Michael A. Mann, P.A.

[57] ABSTRACT

A timepiece having an analog format with a face that has a first series of numbers and a second series of numbers, with the second series of numbers being concentrically aligned within the first series. Both series of numbers indicate civilian time and military time, with the first series corresponding to AM time and the second series corresponding to PM time. The hour hand of the clock has an outer section and an inner section that is slidably received therein. The inner section moves between an extended and retracted position, pointing at the first series of numbers and second series of numbers, respectively. When the inner section is in its retracted position, the timepiece indicates AM time, and when the inner section is in its extended position, the timepiece indicates PM time. In another embodiment, the timepiece has a liquid crystal display that shows an analog format. The hour hand in this format has an extension that is displayed and points to the first series of number indicating PM time. When the extension is not displayed, at the appropriate times, the hour hand points to the second series of number indicating AM time.

20 Claims, 2 Drawing Sheets

TIMEPIECE FOR CONVERTING BETWEEN MILITARY AND CIVILIAN TIME

BACKGROUND OF THE INVENTION

1. Field of the Invention

The present invention relates to a timepiece that converts between military and civilian time. In particular, the present invention relates to a watch, clock, or other timepiece having an analog format, where the hour hand extends or retracts depending on the time of day.

2. Discussion of Background

In civilian time keeping, time is denoted by a series of numbers ranging from one to twelve. In a 24 hour day, the range of one to twelve is repeated with either AM (ante meridian) or PM (post meridian), indicating midnight to noon or noon to midnight, respectively. Consequently, 1:00 AM is late at night and 1:00 PM is in the afternoon.

To prevent having to add the appropriate suffix AM or PM, the military converted to a 24 hour clock denoted by a series of numbers ranging from zero to twenty four. The zero hour is at midnight, so that the clock counts upwards until 23:59, when it changes back to 0:00. In other words, 1:00 AM (civilian time) is equal to 0100 (military time), and 1:00 PM (civilian time) is equal to 1300 (military time).

Typically, most digital format watches are able to convert or display either civilian time or military time. However, most analog format watches having a minute hand and an hour hand are not equipped to differentiate between civilian and military time. Usually a person having an analog clock must mentally convert from civilian to military time by adding twelve to the PM civilian time. Furthermore, in an analog format clock or watch, when the hour hand sweeps around the clock, it is not possible to determine, simply by looking at the clock, whether it is AM or PM.

Therefore, there is a need for a timepiece having an analog format that is able to differentiate between AM and PM time. Furthermore, there is a need for a timepiece having an analog format that allows a person to quickly convert between civilian and military time merely by looking at the timepiece face.

SUMMARY OF THE INVENTION

According to its major aspects and broadly stated, the present invention is a timepiece for converting between civilian and military time. In one preferred embodiment, the timepiece comprises a housing having a face with a shaft extending through its center. Positioned within the housing and operatively connected to the shaft are the gears and other mechanisms that are used to operate the timepiece. Furthermore, there is a minute hand and an hour hand attached to the shaft that are independently controlled and positioned at the appropriate locations to denote the time.

The face of the timepiece has two series of numbers circularly disposed about the face. The first series of numbers and the second series of numbers are concentrically aligned on the face, with the second series of numbers positioned within the first series. The first series of numbers ranges from one to twelve and twelve hundred to twenty-three hundred, corresponding to civilian PM time and the equivalent military time, respectively. The second series of numbers ranges from one to twelve and one hundred to eleven hundred, plus twenty-four hundred, corresponding to civilian AM time and the equivalent military time, respectively.

The hour hand has an outer section and an inner section. The inner section is slidably received within the outer section and has an extended position and a retracted position, so that when the inner section is in the extended position, the inner section points to the first series of numbers corresponding to PM civilian time, and when the inner section is in the retracted position, it points to the second series of numbers corresponding to AM civilian time.

The inner section is controlled by a switch that actuates a device for moving the inner section between its retracted and extended position, depending on the appropriate time of day. In one preferred embodiment, the device that controls the actuation of the inner section comprises a pair of magnets. One magnet is attached to the outer section and the other to the inner section. The magnet that is attached to the outer section is connected to a power source such that the poles of the magnet can be alternated. When the poles of the magnet are alternated, the magnets either attract each other with the inner section moving to the retracted position, or the magnets repel each other, causing the inner section to move to the extend position.

In another preferred embodiment, the outer section of the hour hand is connected to a pressure source proximate to the shaft and has a flange at its distal end. The inner section also has a flange at one end that prevents the inner section from becoming removed from the outer section. Positioned between the flanges of the outer section and the inner section is a spring that is biased so that the inner section is moved towards its retracted position. When the hour hand is switched to move the inner section to the extended position, the pressure source increases the pressure in the outer section, thus moving the inner section to its extended position and pointing to the first series of numbers. When the inner section is to be moved to the retracted position, the pressure within the outer section is relieved and the spring moves the inner section.

In another preferred embodiment, the timepiece comprises a liquid crystal display which shows an analog format. The minute hand and hour hand of the timepiece are driven by electronics within the housing of the timepiece. The face of the timepiece is similar to that described above, but the hour hand has an extension that is displayed to point to the first series of numbers, when it is the appropriate time of day. The extension is aligned with the hour hand and rotates about a center point on the face of the timepiece as the hour hand rotates. In addition, there is a minute hand that is controlled so as to rotate about the same center point on the face of the timepiece.

A major feature of the present invention is the two positions of the hour hand, either by the movement of the inner section or the addition of the extension in the liquid crystal display model. By extending and retracting or displaying and removing the inner section and extension, respectively, a person is able to quickly glance at the face of the timepiece and determine the appropriate civilian time and appropriate military time.

Another feature of the present invention is the combination of the extendable hour hand and the first and second series of numbers disposed about the face of the timepiece. This combination enables the timepiece to accurately show both AM and PM time, depending on the position of the inner section or the display of the extension.

Still another feature of the present invention is the analog format of the liquid crystal display, which incorporates liquid crystal display technology and an analog or traditional format. This provides a timepiece that shows civilian and military time and AM and PM time on a liquid crystal display in an analog format.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1A:
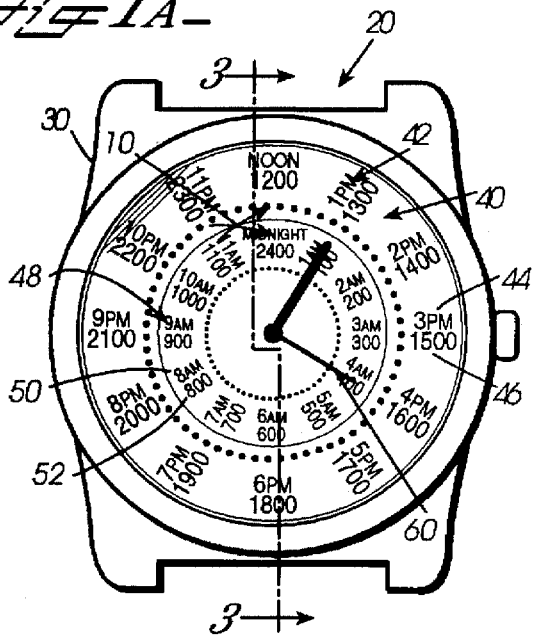
FIG. 1A is a front view of an electro-mechanical timepiece showing 1:20 AM (civilian time), according to a preferred embodiment of the present invention.
Figure 1B:
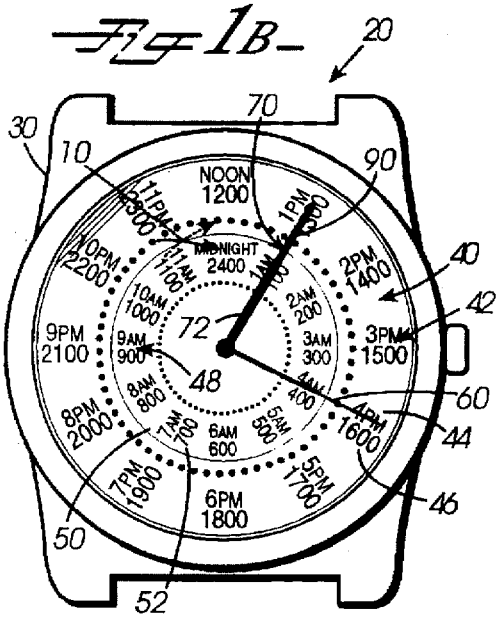
FIG. 1B is a front view of an electro-mechanical timepiece showing 1:20 PM (civilian time), according to a preferred embodiment of the present invention.
Figure 3:
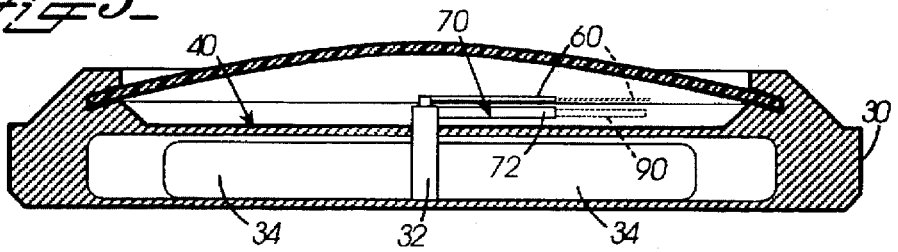
FIG. 3 is a cross-sectional view of FIG. 1A with the hour hand and minute hand at the 12:00 position and with the hour hand extended in dashed lines, according to, a preferred embodiment of the present invention.

Referring now to FIGS. 1A, 1B, and 3, a timepiece 20 according to a preferred embodiment is shown. Timepiece 20 comprises a housing 30 with a face 40 and a shaft 32 that extends through face 40. A minute hand 60 and an hour hand 70 are connected to shaft 32 so that they are independently controlled to show the appropriate time. Positioned within housing 30 are the gears, batteries, and other required structure 34 for the operation of timepiece 20.

Face 40 of timepiece 20, as shown in FIGS. 1A and 1B, has a first series of numbers 42 circularly disposed about the perimeter of face 40. A second series of numbers 48 is also circularly disposed about face 40. First series of numbers 42 and second series of numbers 48 are concentrically aligned on face 40, with second series of numbers 48 having a smaller diameter than first series of numbers 42.

First series of numbers 42 corresponds to PM (post meridian) time and as shown in FIGS. 1A and 1B, has top numbers 44 and bottom numbers 46. Top numbers 44 correspond to civilian time and range from 1 to 12, including "noon". Bottom numbers 46 correspond to military time and range from 1200 to 2300. Top numbers 44 and bottom numbers 46 are positioned in pairs in a circular array about face 40.

Second series of numbers 48 correspond to AM (ante meridian) time and as shown in FIGS. 1A and 1B, has top numbers 50 and bottom numbers 52. Top numbers 50 correspond to civilian time and range from 1 to 12, including "midnight". Bottom numbers 52 correspond to military time and range from 100 to 1100, and include the number 2400. Top numbers 50 and bottom numbers 52 are arranged in pairs and are positioned in a circular array within first series of numbers 42.

Figure 4A:
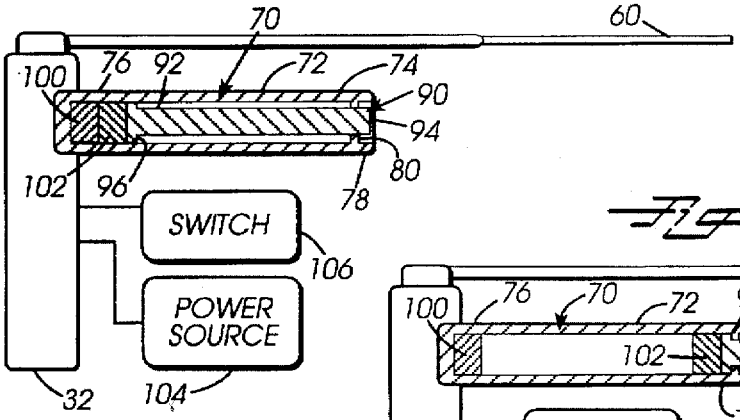
FIG. 4A is a side view and partial cut-away view of the hour and minute hand of a timepiece with the hour hand in the retracted position, according to a preferred embodiment of the present invention.
Figure 4B:
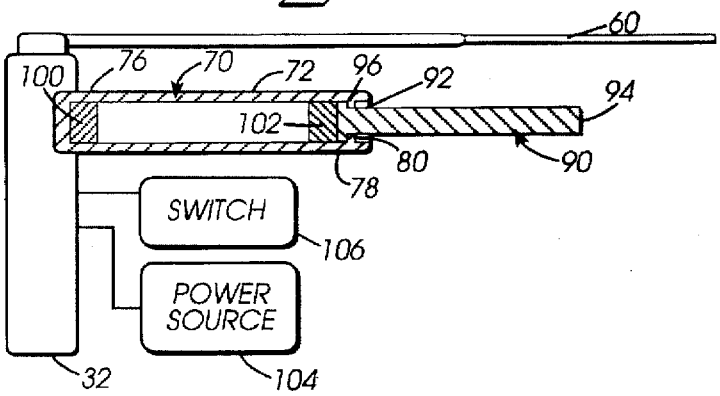
FIG. 4B is a side view and partial cut-away view of the hour and minute hand of a timepiece with the hour hand in the extended position, according to a preferred embodiment of the present invention.
Figure 5A:
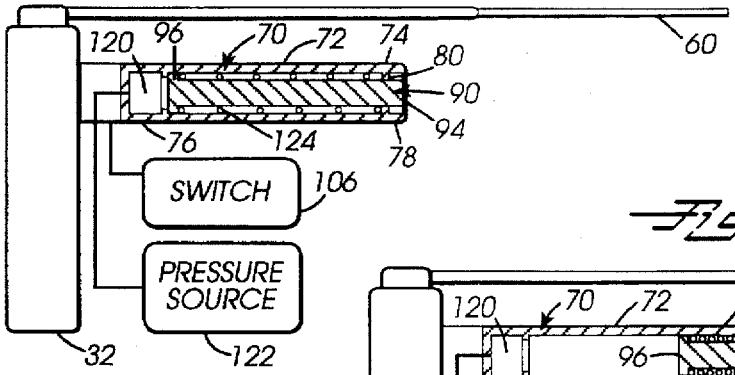
FIG. 5A is a side view and partial cut-away view of the hour and minute hand of a timepiece with the hour hand in the retracted position, according to another preferred embodiment of the present invention.
Figure 5B:
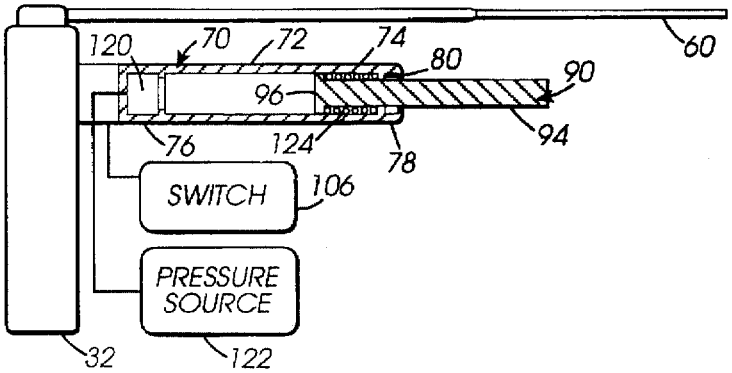
FIG. 5B is a side view and partial cut-away view of the hour and minute hand of a timepiece with the hour hand in the extended position, according to another preferred embodiment of the present invention.

Hour hand 70 comprises an outer section 72 and an inner section 90 which is slidably received within outer section 72. Inner section 90 slides between a retracted position as shown in FIGS. 1A, 4A, and 5A, and an extended position as shown in FIGS. 1B, 4B, and 5B. As specifically shown in FIGS. 1A and 1B, when inner section 90 is in the retracted position, inner section 90 points to second series of numbers 48, thus indicating AM time, denoted by both civilian and military notations. When inner section 90 is in the extended position, inner section 90 points to first series of numbers 42, thus indicating PM time, denoted by both civilian and military time. As hour hand 70 and minute hand 60 rotate about shaft 32, inner section 90 moves between its retracted position and extended position, depending on the time of day, as the directional indicators 10 of FIGS. 1A and 1B, shown in dashed lines indicate. It should be noted that the direction indicators are not part of the present invention, but are provided to further aid and illustrate the movement of inner section 90.

In one preferred embodiment as shown in FIGS. 4A and 4B, outer section 72 comprises a substantially hollow tube 74 having a first end 76 and a second end 78. First end 76 is the end of outer section 72 proximate to shaft 32. Inner section 90 also has a first end 92 and a second end 94. As stated above, inner section 90 is slidably received within outer section 72, but is prevented from falling out of outer section 72 by a flange 96 on first end 92 of inner section 90 that engages an internal flange 80 positioned at second end 78 of outer section 72.

The movement of inner section 90 is controlled by a first magnet 100 positioned within first end 76 of outer section 72 and a second magnet 102 positioned on first end 92 of inner section 90. First magnet 100 and second magnet 102 have a north pole and a south pole, as is typical with magnets. Furthermore, as is well known, when these magnets are aligned, like poles repel and dissimilar poles attract. Consequently, timepiece 20 is provided with a power source 104 that is connected to first magnet 100, such that the specific pole of first magnet 100 can be alternated. A switch 106 is also provided in timepiece 20 which determines when the poles of first magnet 100 will be alternated. When the poles are alike, inner section 90 is moved to its extended position, pointing at PM time, and when the poles are dissimilar, inner section 90 is moved to its retracted position, pointing to AM time.

In another preferred embodiment, as shown in FIGS. 5A and 5B, inner section 90 is moved between its retracted and extended position by another method. Inner section 90 and outer section 72 are constructed similar to the above description, except that outer section 72 has a chamber 120 located at first end 76. Additionally, there is a spring 124 positioned between flange 96 of inner section 90 and internal flange 80 of outer section 72, which biases inner section 90 to its retracted position. A pressure source 122 is connected to chamber 120 of outer section 72, so that when actuated by switch 106, pressure is increased within chamber 120 and outer section 72. This pressure builds until it forces inner section 90 to its extended position against the force of spring 124. When it is necessary for inner section 90 to move to its retracted position, the pressure within chamber 120 and outer section 72 is relieved, so that spring 124 moves inner section 90 back within outer section 72.

In a device where space, power, and monetary requirements are not a factor, those of ordinary skill in the art will recognize that various kinds of electro-mechanical, electromagnetic, or mechanical configurations for the movement of inner section 90 are possible.

Figure 2A:
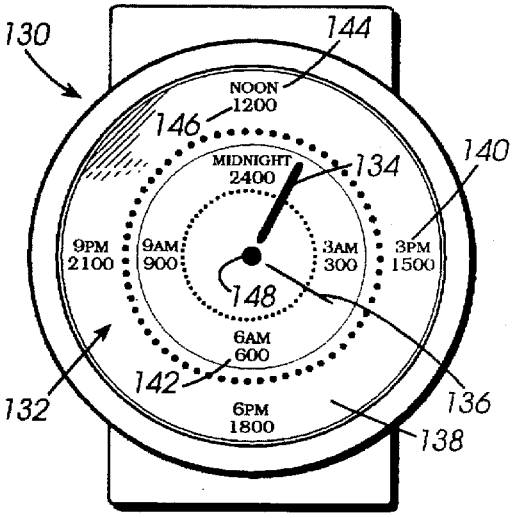
FIG. 2A is a front view of a liquid crystal display timepiece showing 1:20 AM (civilian time), according to another preferred embodiment of the present invention.
Figure 2B:
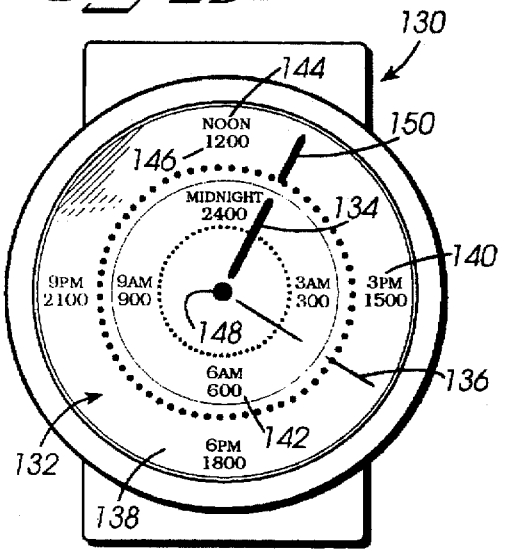
FIG. 2B is a front view of a liquid crystal display timepiece showing 1:20 PM (civilian time), according to another preferred embodiment of the present invention.

In another preferred embodiment, as shown in FIGS. 2A and 2B, timepiece 130 has a liquid crystal display (LCD) 132 that displays an analog format having an hour hand 134 and a minute hand 136. LCD 132 also has a face 138 similar to the one described above. Face 138 has a first series of numbers 140 and a second series of numbers 142 that are both circularly disposed on face 138. As above, first series of numbers 140 and second series of numbers 142 are concentrically aligned, with second series of numbers 142 having a smaller diameter than first series of numbers 140. Both series of numbers 140, 142 are arranged in pairs, with a top number 144 corresponding to civilian time and a bottom number 146 corresponding to military time.

As LCD 132 shows an analog format, hour hand 134 and minute hand 136 are basically elongated members simulating the typical mechanical clock structure. In other words, hour hand 134 and minute hand 136 rotate about a center point 148 on face 138 of LCD 132. In addition, hour hand 134 has an extension 150 that is displayed on face 138 of LCD 132 and which rotates with hour hand 134 about center point 148. When displayed, extension 150 points to first series of numbers 140, thus indicating PM time. When extension 150 is not displayed, the hour hand points to second series of numbers 142, thus indicating AM time.

As those skilled in the art will appreciate, LCD 132 has tiny capsules filled with liquid crystals arranged in the desired pattern. When the molecules of the liquid crystals are subjected to an electric field, the liquid crystals align, and light reflects off of them. Without the electric field, their alignment returns to its original alignment, a non-reflecting arrangement, so that the capsules appear dark. Those of ordinary skill in the art will recognize how to arrange these capsules and provide the necessary electrical supplies to produce and drive the analog format of LCD 132 and to display hour hand 134, extension 150, and minute hand 136 in the appropriate format and position, as described above.

It should also be noted that timepieces 20, 130 may be constructed as a wrist watch, pocket watch, clock, or other device that is capable of telling time.

In addition, those of ordinary skill in the art will recognize that timepieces 20 and 130 may include a second hand. Additionally, timepieces 20 and 130 could be configured so that minute hands 60 and 136 extend and retract similar to the movement of hour hands 70 and 134.

It will be apparent to those skilled in the art that many changes and substitutions can be made to the preferred embodiment herein described without departing from the spirit and scope of the present invention as defined by the appended claims.

What is claimed is:

1. A timepiece for indicating the time of day, said timepiece comprising:

a housing having a circular face;

a shaft within said housing, said shaft extending through said face;

a minute hand carried by said shaft;

an hour hand carried by said shaft, said hour hand having a retracted position and an extended position;

means for moving said hour hand between said extended and said retracted position, so that when said hour hand is in said retracted position said hour hand indicates AM time, and when said hour hand is in said extended position said hour hand indicates PM time; and a switch for actuating said moving means for moving said hour hand from said retracted position to said extended position and said hour hand from said extended position to said retracted position.

2. The timepiece as recited in claim 1, wherein said face indicates civilian and military time.

3. The timepiece as recited in claim 1, wherein said PM time is indicated by a first series of numbers on said fade, and said AM time is indicated by a second series of numbers.

4. The timepiece as recited in claim 1, wherein said PM time is indicated by a first series of numbers on said face, and wherein said hour hand points to said first series of numbers when said hour hand is in said extended position.

5. The timepiece as recited in claim 1, wherein said AM time is indicated by a second series of numbers on said face, and wherein said hour hand points to said second series of numbers when said hour hand is in said retracted position.

6. The timepiece as recited in claim 1, wherein said hour hand has an outer section carried by said shaft and an inner section slidably received within said outer section; said face further comprises a first series of numbers circularly disposed about said face and a second series of number circularly disposed about said face, said first series of numbers being concentric with said second series of numbers, said second series of number having a smaller diameter than said first series of numbers; and said moving means comprises an electro-magnetic device.

7. The timepiece as recited in claim 1, wherein said hour hand has an outer section carried by said shaft and an inner section slidably received within said outer section.

8. The timepiece as recited in claim 1, wherein said face indicates civilian and military time and said PM time is indicated by a first series of numbers on said face, and said AM time is indicated by a second series of numbers.

9. The timepiece as recited in claim 1, wherein said PM time is indicated by a first series of numbers on said face, said hour hand points to said first series of numbers when said hour hand is in said extended position, and said AM time is indicated by a second series of numbers on said face, wherein said hour hand points to said second series of numbers when said hour hand is in said retracted position.

10. A device for indicating the time of day, said device comprising:

a housing having a face;

a liquid crystal display positioned within said housing;

means for driving said liquid crystal display;

a minute hand positioned on said face and controlled by said driving means;

an hour hand positioned on said face and controlled by said driving means; and an extension aligned with said hour hand, said extension being displayed on said face when controlled by said driving means.

11. The device as recited in claim 10, wherein said driving means controls said extension so that said extension to said hour hand indicates PM time.

12. The device as recited in claim 10, wherein said face further comprises a first means for indicating PM time and a second means for indicating AM time, said first indicating means being concentric with said second indicating means, said second indicating means having a diameter less than said first indicating means.

13. The device as recited in claim 10, wherein said face further comprises a first means for indicating PM time and a second means for indicating AM time, said first indicating means being concentric with said second indicating means, said second indicating means having a diameter less than said first indicating means; and wherein said hour hand points to said second indicating means and when said extension is displayed by said driving means, said extension points to said first indicating means.

14. The device as recited in claim 10, wherein said face has a center point, and wherein said hour hand is a first elongated member, said minute hand is a second elongated member, and said extension is a third elongated member, said first, second, and third elongated members being rotated about said center point of said face by said driving means.

15. A device for indicating the time of day, said device comprising:

a housing having a face;

a shaft positioned within said housing and extending through said face;

a minute hand carded by said shaft;

an hour hand, said hour hand having an outer section carried by said shaft and an inner section that is slidably received within said outer section, said inner section having an extended position and a retracted positioned;

means for moving said inner section of said hour hand between said extended position and said retracted position; and a switch for actuating said moving means for moving said inner section of said hour hand from said retracted position to said extended position and said hour hand from said extended position to said retracted position.

16. The device as recited in claim 15, wherein said inner section has a first end and a second end, and wherein said moving means comprises:

a first magnet carried within said outer section proximate to said shaft, said first magnet having a north pole and a south pole;

a second magnet carded by said first end of said inner section; and a power source for alternating between said north pole and said south pole of said first magnet, so that said second magnet is alternately attracted and repelled by said first magnet.

17. The device as recited in claim 15, wherein said inner section has a first end and a second end and said face further comprises a first series of numbers circularly disposed about said face and a second series of number circularly disposed about said face, said first series of numbers being concentric with said second series of numbers, said second series of numbers having a smaller diameter than said first series of numbers, and said first series of numbers corresponding to PM time and said second series of numbers corresponding to AM time; and wherein said moving means comprises:

a first magnet carded within said outer section proximate to said shaft, said first magnet having a north pole and a south pole;

a second magnet carried by said first end of said inner section; and a power source for alternating between said north pole and said south pole of said first magnet, so that said second magnet is alternately attracted and repelled by said first magnet, said inner section of said hour hand pointing to said second series of numbers when said first magnet is attracting said second magnet, and said inner section of said hour hand pointing to said first series of numbers when said first magnet repels said second magnet.

18. The device as recited in claim 15, wherein said outer section has a first end and a second end, said first end of said outer section positioned proximate to said shaft and said second end having an internal flange, and wherein said inner section has a first end and a second end, said first end of said inner section having a flange, and wherein said moving means further comprises:

a spring biased between said internal flange of said outer section and said flange of said inner section; and a pressure source operatively connected to said first end of said outer section whereby said switch operates said pressure source, so that when said pressure source supplies a pressure within said outer section, said inner section moves from said retracted position to said extended position, said spring moving said inner section from said extended position to said retracted position when said pressure within said outer section is relieved.

19. The device as recited in claim 15, wherein said outer section has a first end and a second end, said first end of said outer section positioned proximate to said shaft and said second end having a internal flange positioned within said outer section, and wherein said inner section has a first end and a second end, said first end of said inner section having a flange, and said face further comprises a first series of numbers circularly disposed about said face and a second series of numbers circularly disposed about said face, said first series of numbers being concentric with said second series of numbers, said second series of numbers having a smaller diameter than said first series of numbers, and said first series of numbers corresponding to PM time and said second series of numbers corresponding to AM time, and wherein said moving means further comprises:

a spring biased between said internal flange of said outer section and said flange of said inner section;

a pressure source operatively connected to said first end of said outer section; and a switch for operating said pressure source, so that when said pressure source supplies a pressure within said outer section, said inner section moves from said retracted position to said extended position, said spring moving said inner section from said extended position to said retracted position when said pressure within said outer section is relieved, said inner section pointing to said first series of numbers when said inner section is in said extended position, and said inner section pointing to said second series of numbers when said inner section is in said retracted position.

20. The device as recited in claim 15, further comprising a switch for actuating said moving means for moving said inner section of said hour hand from said retracted position to said extended position and said inner section of said hour hand from said extended position to said retracted position.

* * * * *